US005181072A

United States Patent [19]

Furuya et al.

[11] Patent Number: 5,181,072

[45] Date of Patent: Jan. 19, 1993

[54] COLOR RECORDING APPARATUS

[75] Inventors: Nobumasa Furuya; Tsuneo Noami; Takeshi Sumikawa, all of Kanagawa, Japan

[73] Assignee: Fuji Xerox Co., Ltd., Tokyo, Japan

[21] Appl. No.: 733,619

[22] Filed: Jul. 22, 1991

[30] Foreign Application Priority Data

Aug. 3, 1990 [JP] Japan ..... 2-206309

[51] Int. Cl.[5] ..... G03G 15/02

[52] U.S. Cl. ..... 355/225; 355/326

[58] Field of Search ..... 355/225, 219, 326, 221, 355/223, 245; 250/324, 325, 326

[56] References Cited

U.S. PATENT DOCUMENTS 4,791,452 12/1988 Kasai et al. ..... 355/219 X
4,811,045 3/1989 Matsushita et al. ..... 355/219
4,828,953 5/1989 Oka et al. ..... 355/245 X

FOREIGN PATENT DOCUMENTS 58-116553 7/1983 Japan .
59-190854 10/1984 Japan .

*Primary Examiner*—A. T. Grimley
*Assistant Examiner*—Shuk Y. Lee
*Attorney, Agent, or Firm*—Finnegan, Henderson, Farabow, Garrett and Dunner

[57] ABSTRACT

In a color recording apparatus, charges are applied to a latent electrostatic image carrier by a scorotron having a grid after development of a first latent electrostatic image on the carrier with a first color toner. Thereafter, a second electrostatic latent image is formed and developed with a second color toner. If the charges given by the scorotron have the same polarity as a charging polarity of the first color toner, a potential of the grid is set to be equal to a non-image portion potential of the first latent electrostatic image, or set to have a polarity opposite to that of an image portion potential of the first latent electrostatic image assuming that the non-image portion potential is regarded as 0 V as a reference potential. If the charges given by the scorotron have a polarity opposite to the charging polarity of the first color toner, a potential of the grid is set to have a polarity opposite to that of the non-image portion potential image assuming that the image portion potential is regarded as 0 V as a reference potential.

9 Claims, 4 Drawing Sheets

COLOR RECORDING APPARATUS

BACKGROUND OF THE INVENTION

The present invention relates to an apparatus for recording a color image by use of a latent electrostatic image, and particularly relates to a color recording apparatus in which toner images obtained by repeating the processes of charging, latent image formation and development are en bloc transferred onto a recording sheet.

There is known a conventional color recording apparatus as disclosed in Japanese Unexamined Patent Publication No. Sho. 58-116553. In this apparatus, two-color toner images are first formed on a photoreceptor by performing two-times the processes of charging, image-portion exposure and reversal development, and then the resultant toner images are en bloc transferred onto a recording sheet. In addition, the second charging is performed by use of a scorotron after the first development to make the potential of image portions approximately equal to that of non-image portions, and a soft-type one-component magnetic toner is used for the second development, to prevent electrical scraping of the first toner and to prevent the second toner from adhering to first image portions (the latter phenomenon is hereinafter referred to as "color contamination").

However, in the method disclosed in Japanese Unexamined Patent publication No. Sho. 58-116553, since lines of electric force develop near the photoreceptor and between the first image portions and non-image portions at the time of the second charging, peripheral portions of the first image are not charged enough and the electric potential of those portions remains low. As a result, the peripheral portions of the first image are also developed in the second development, causing the quality of the first image to deteriorate. FIG. 6 schematically shows the occurrence of the development of the peripheral portions of the first image.

Further, the method is also accompanied by the following problem. Since a development bias needs to be set so as to avoid the color contamination in the second development, the difference between the second development bias and the potential of the first image portions becomes large. As a result, the first toner may be scraped electrically and mixed into a second developer, so that the density of the first image is decreased and the life of a second developing agent is reduced.

SUMMARY OF THE INVENTION

It is therefore an object of the present invention to prevent the second-toner development on peripheral portions of the first image and the contamination of the first toner into the second developer.

According to the present invention, a color recording apparatus is provided in which charges are applied to a latent electrostatic image carrier by a scorotron having a grid after development of a first latent electrostatic image on the latent electrostatic. image carrier with a first color toner. Thereafter a second latent electrostatic image is formed and developed with a second color toner, such that if the charges given by the scorotron have the same polarity as a charging polarity of the first color toner, a potential of the grid is set to be equal to a non-image portion potential of the first latent electrostatic image, or set to have a polarity opposite to that of an image portion potential of the first latent electrostatic image assuming that the non-image portion potential is regarded as 0 V as a reference potential. If the charges given by the scorotron have a polarity opposite to the charging polarity of the first color toner, a potential of the grid is set to have a polarity opposite to that of a non-image portion potential of the first latent electrostatic image assuming that the image portion potential is regarded as 0 V as a reference potential.

In addition, if the charges given by the scorotron have the same polarity as the charging polarity of the first color toner, it is preferred that the difference between the grid potential and the non-image portion potential of the first latent electrostatic image is set at not less than 50 V. If the charges given by the scorotron have a polarity different from the charging polarity of the first color toner, it is preferred that the difference between the grid potential and the image portion potential of the first latent electrostatic image is set at not less than 150 V.

With the second charger grid potential being set as described above, it is possible to charge the first image peripheral portions sufficiently, so that the second-toner development on the first image peripheral portions can be prevented. Further, since sufficient charges can be applied to the first toner in the second charging process, the adhesion of the first toner to the photoreceptor surface is increased and, therefore, scraping of the first toner is avoided.

DESCRIPTION OF THE PREFERRED EMBODIMENTS

An embodiment of the present invention will be described hereinafter with reference to the accompanying drawings.

Figure 1:
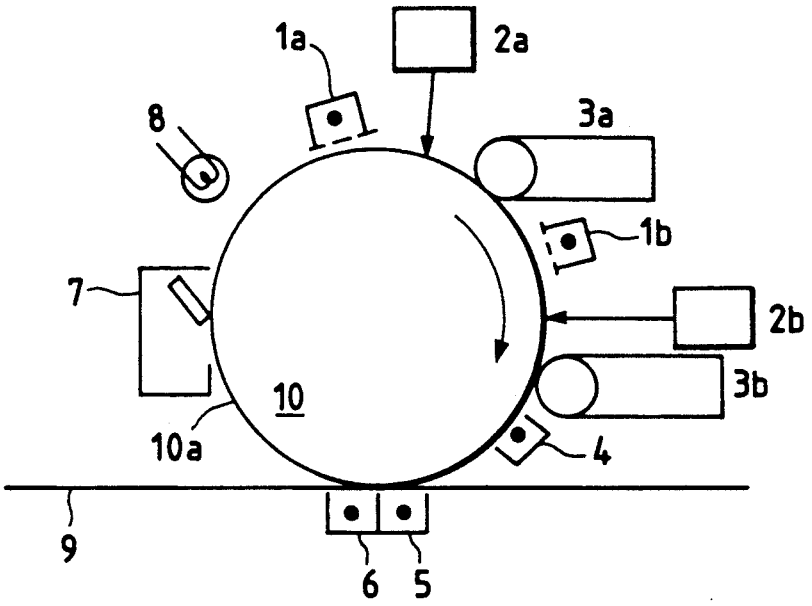
FIG. 1 is a schematic diagram showing the configuration of a color recording apparatus used for practicing an embodiment of the present invention.

FIG. 1 shows an example of a color recording apparatus to which the present invention is applied. Reference numeral 1*a* represents a first charger; 2*a*, first exposure means; 3*a*, first developing means; 1*b*, second charger; 2*b*, second exposure means; 3*b*, second developing means; 4, pre-transfer corotron; 5, transfer corotron; 6, separation corotron; 7, cleaner; 8, optical discharger; 9, recording sheet; 10, photoreceptor drum; and 10*a*, photoreceptor.

The photoreceptor drum 10 rotates in the direction indicated by the arrow in the figure. First, the surface of the photoreceptor 10*a* is charged uniformly by the first charger 1*a*. Next, the first exposure means 2*a* performs exposure in accordance with the image information corresponding to a first color, thereby forming a first latent electrostatic image on the photoreceptor 10*a*. Then, the latent electrostatic image is developed by the first developing means 3*a* using a toner corresponding to the first color, and appears as an actual image. Then, the surface of the photoreceptor body 10*a* is again charged by the second charger 1*b*. Next, the second exposure means 2*b* performs exposure in accordance with the image information corresponding to a second color, thereby forming a second latent electrostatic image on the photoreceptor 10*a*. Next, the second latent electrostatic image is developed by the second developing means 3*b* using a toner corresponding to the second color. The pre-transfer corotron 4 is provided for equating, before the transfer process, the polarities of the first and second toners held on the photoreceptor 10*a*, or for improving the transfer property, when required. The first and second toners are transferred onto the recording sheet 9 by the transfer corotron 5, and the recording sheet 9 is then separated from the photoreceptor drum 10 by the separation corotron 6. The first and second toners are next fused on the recording sheet in a fusing section (not shown). The photoreceptor 10*a* is subjected to the operations of the cleaner 7 and the optical discharger 8 for its subsequent use.

The first and second exposure means may be selected from a laser write apparatus, an LED array, a liquid crystal light bulb consisting of a uniform light source and a liquid crystal micro-shutter, etc., in accordance with the purpose.

Figure 2:
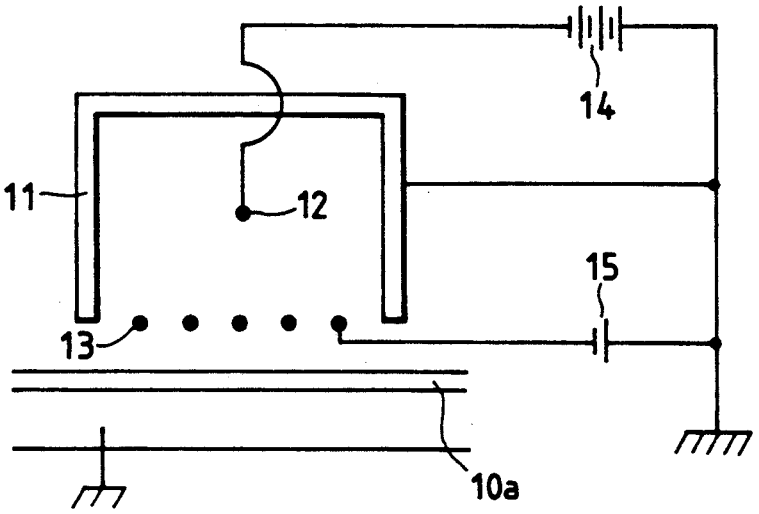
FIG. 2 is a schematic diagram of a scorotron used in a second charging process of the invention.

The second charger 1*b* used in this embodiment will be described below with reference to FIG. 2. A metal wire having a diameter of about 30–150 μm is provided, as a corona wire 12, inside a metal case 11, and supplied with a high voltage of about 4–9 kV. A plurality of metal wires each having a diameter of about 30–150 μm are provided, as grid wires 13, in the opening portion of the metal case 11 with the pitch of about 1–3 mm. The corona wire 12 and the grid wire 13 are connected to power supplies 14 and 15, respectively.

In this embodiment, a negatively chargeable organic photo-conductor (hereinafter abbreviated as "OPC") is used as the photoreceptor 10*a*. The linear movement speed of the photoreceptor surface is 160 mm/s. A two-component developing agent composed of a red toner and a ferrite particle carrier having the average particle diameter of 100 μm is used for the first development. Another two-component developing agent composed of a black toner and a carrier having the average particle diameter 40 μm in which a magnetic powder is dispersed in a resin is used for the second development. Both the first and the second development processes employ the magnetic brush development.

Experiment 1

Using the color recording apparatus shown in FIG. 1, an experiment was carried out in which the image portion exposure was employed in both the first and second exposures, and the reversal development was employed in both the first and second developments. The toner was negatively charged in both the first and second developments. The polarity of charges applied in the second charging was negative, that is, the same as the charging polarity of the first toner.

The image forming steps of the experiment will be described with reference to FIG. 3.

Figure 3:
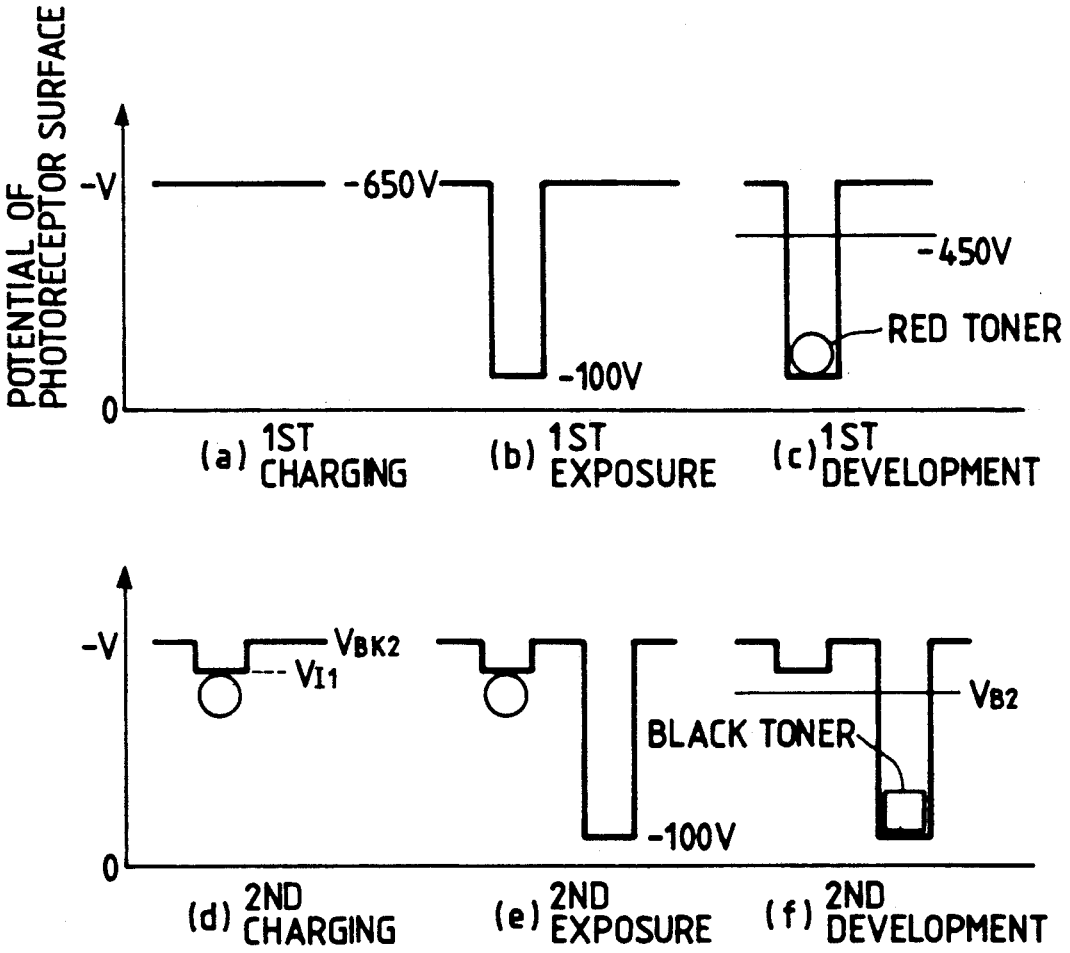
FIG. 3 is a chart showing a potential of a photoreceptor surface in Experiment 1.

First, the surface of the OPC was charged uniformly to −650 V by the first charger 1*a* (FIG. 3(*a*)). Next, image portion exposure was performed by the first exposure means 2*a* using laser light to thereby form a negative latent image having an exposed portion potential of −100 V (FIG. 3(*b*)). This negative latent image was reversely developed by the first developing means 3*a* with a developing bias of −450 V (FIG. 3(*c*)). Then, charging was performed by the second charger 1*b* (FIG. 3(*d*)), and a negative latent image having an exposed portion potential of −100 V was formed by the second exposure means 2*b* using laser light (FIG. 3(*e*)). Finally, reversal development was performed by the second developing means 3*b* (FIG. 3(*f*)).

The above experiment was conducted while changing the grid potential of the second charger 1*b*, to examine the relationship between the grid potential and the two phenomena: the second toner development on the first image peripheral portions (hereinafter referred to as "peripheral development") and the reduction in the first image density. The distance between the grid and the photoreceptor 10*a* was selected to be 1.0 mm, and the corona wire voltage was set at −5.5 kV. The first non-image portion potential $V_{BK1}$ before the second charging was −600 V. To prevent the occurrence of color contamination and dirt on non-image portions, the second developing bias was set at the first image portion potential after the second charging plus 100 V.

The results were evaluated in the following manner. The reduction in the first image density was evaluated on the basis of the difference obtained by subtracting the first image density of the two-color image, which has been subjected to the influence of the second development, from the density of the single first color image, which of course has not been influenced by the second development. The density was measured with a reflection density meter. On the other hand, the "peripheral development" was evaluated by its degree. Mark "o" means no occurrence, "Δ" means a practically allowable level in spite of slight occurrence (corresponding to reflection densities not more than 0.25), and "x" means an unusable level (corresponding to reflection densities not less than 0.25).

As a result, Table 1 was obtained. In Table 1, $V_{BK2}$ represents the non-image portion potential after the second charging, and $V_{I1}$ the first image portion potential after the second charging.

TABLE 1

| | | | | | |
|---|---|---|---|---|---|
| $V_G$ (V) | −500 | −550 | −600 | −650 | −700 |
| $V_{BK1}$-$V_G$ (V) | −100 | −50 | 0 | 50 | 100 |
| $V_{BK2}$ (V) | −600 | −600 | −600 | −650 | −700 |
| $V_{I1}$ (V) | −450 | −490 | −550 | −620 | −680 |
| First image density reduction | 0.5 | 0.3 | 0.0 | 0.0 | 0.0 |
| Peripheral development | x | x | Δ | o | o |

From Table 1, it is understood that the peripheral development can be prevented if the following relationship between the second charger grid potential $V_G$ and the first non-image portion potential $V_{BK1}$ is established:

$$|V_G| \geqq |V_{BK1}|.$$

That is, when the first non-image portion potential $V_{BK1}$ is regarded as 0 V (reference potential), the second charger grid potential $V_G$ should be set to be opposite in polarity to the first image portion potential or at 0 V. In addition, with this setting, charges are given to the first toner to increase its adhesion to the photoreceptor surface, so that the first toner is not scraped off in the second development and, therefore, density reduction or contamination does not occur.

Further, if the potential difference between $V_G$ and $V_{BK1}$ is set to a value not less than 50 V, the peripheral development can be prevented more effectively.

Experiment 2

Using the color recording apparatus shown in FIG. 1, the second experiment was performed in which the first and second exposures employed non-image portion exposure and image portion exposure, respectively, and the first and second developments employed normal development and reversal development, respectively. The toner was charged positively in the first development, and negatively in the second development. The polarity of charges applied in the second charging was positive, that is, the same as the charging polarity of the first toner.

The image forming steps will be described with reference to FIG. 4.

Figure 4:
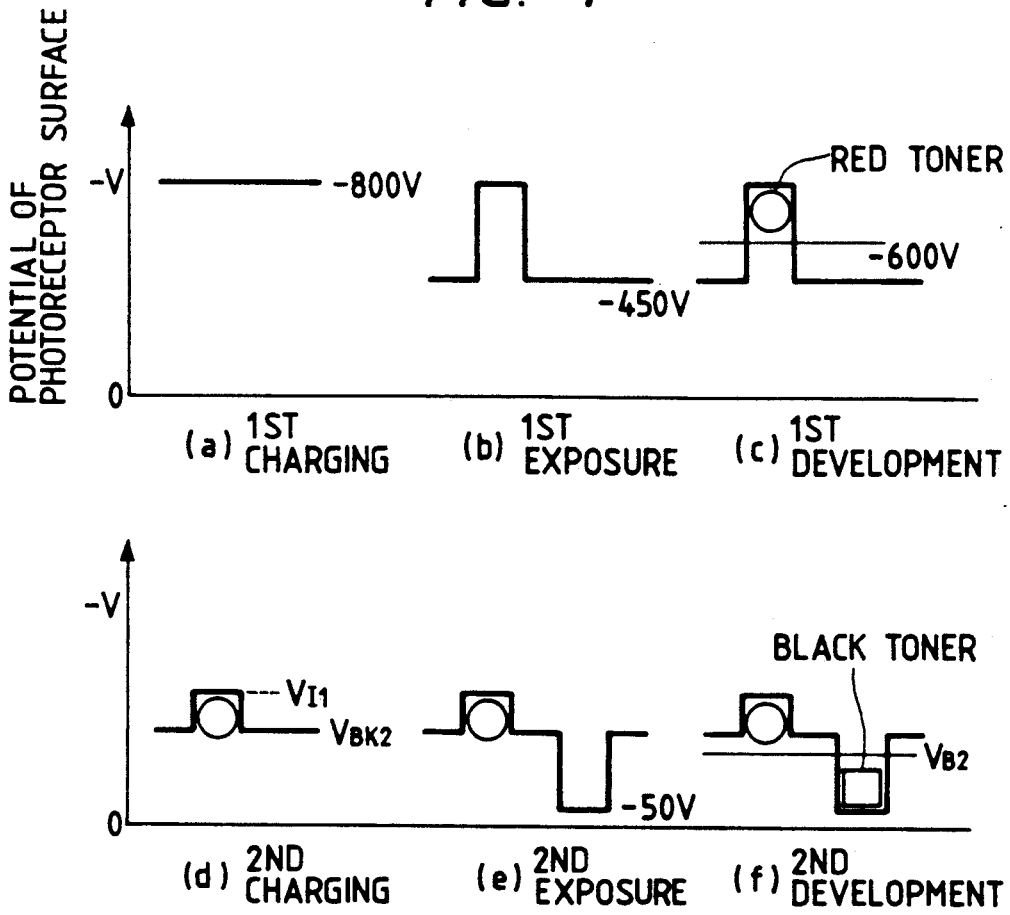
FIG. 4 is a chart showing a potential of a photoreceptor surface in Experiment 2.

First, the surface of the OPC was charged uniformly to −800 V by the first charger 1*a* (FIG. 4(*a*)). Next, the non-image portion exposure was performed by the first exposure means 2*a* using laser light to form a positive latent image having an exposed portion potential of −450 V (FIG. 4(*b*)). This positive latent image was normally developed by the first developing means 3*a* with a developing bias of −600 V (FIG. 4(*c*)). Then, charging was performed by the second charger 1*b* (FIG. 4(*d*)), and a negative latent image having an exposed portion potential of −50 V was formed by the second exposure means 2*b* using laser light (FIG. 4(*e*)). Finally, reversal development was performed by the second developing means 3*b* (FIG. 4(*f*)).

The relationship between the grid potential of the second charger 1*b* and the two phenomena, the peripheral development and the reduction in the first image density, was examined by changing the second charger grid potential. The distance between the grid and the photoreceptor 10*a* was selected to be 1.0 mm, and the corona wire voltage was set at +5.5 kV. The first non-image portion potential $V_{BK1}$ before the second charging was −400 V. The second developing bias was set at the non-image portion potential after the second charging plus 100 V to prevent the occurrence of color contamination and dirt on non-image portions.

The evaluation of results was performed in the same manner as in Experiment 1, and Table 2 was obtained.

TABLE 2

| | | | | | |
|---|---|---|---|---|---|
| $V_G$ (V) | −300 | −350 | −400 | −450 | −500 |
| $V_G$-$V_{BK1}$ (V) | 100 | 50 | 0 | −50 | −100 |
| $V_{BK2}$ (V) | −300 | −350 | −400 | −400 | −400 |
| $V_{I1}$ (V) | −330 | −390 | −450 | −540 | −580 |
| First image density reduction | 0.0 | 0.0 | 0.0 | 0.0 | 0.0 |
| Peripheral development | ○ | ○ | Δ | x | x |

From Table 2, it is understood that the peripheral development can be prevented if the following relationship between the second charger grid potential $V_G$ and the first non-image portion potential $V_{BK1}$ is established:

$$|V_G| \leqq |V_{BK1}|.$$

That is, when the first non-image portion potential $V_{BK1}$ is regarded as 0 V (reference potential), the second charger grid potential $V_G$ should be set to be opposite in polarity to the first image portion potential or at 0 V. In addition, with this setting, charges are given to the first toner to increase its adhesion to the photoreceptor surface, so that the first toner is not electrically scraped off in the second development and, therefore, density reduction or contamination does not occur.

Further, if the potential difference between $V_G$ and $V_{BK1}$ is set to a value not less than 50 V, the peripheral development can be prevented more effectively.

Experiment 3

Using the color recording apparatus shown in FIG. 1, the third experiment was performed in which the first and second exposures employ non-image portion exposure and image portion exposure, respectively, and the first and second developments employ normal development and reversal development, respectively. The toner was charged positively in the first development and negatively in the second development. The polarity of charges applied in the second charging was negative, that is, opposite to the charging polarity of the first toner.

The image forming steps will be described with reference to FIG. 5.

Figure 5:
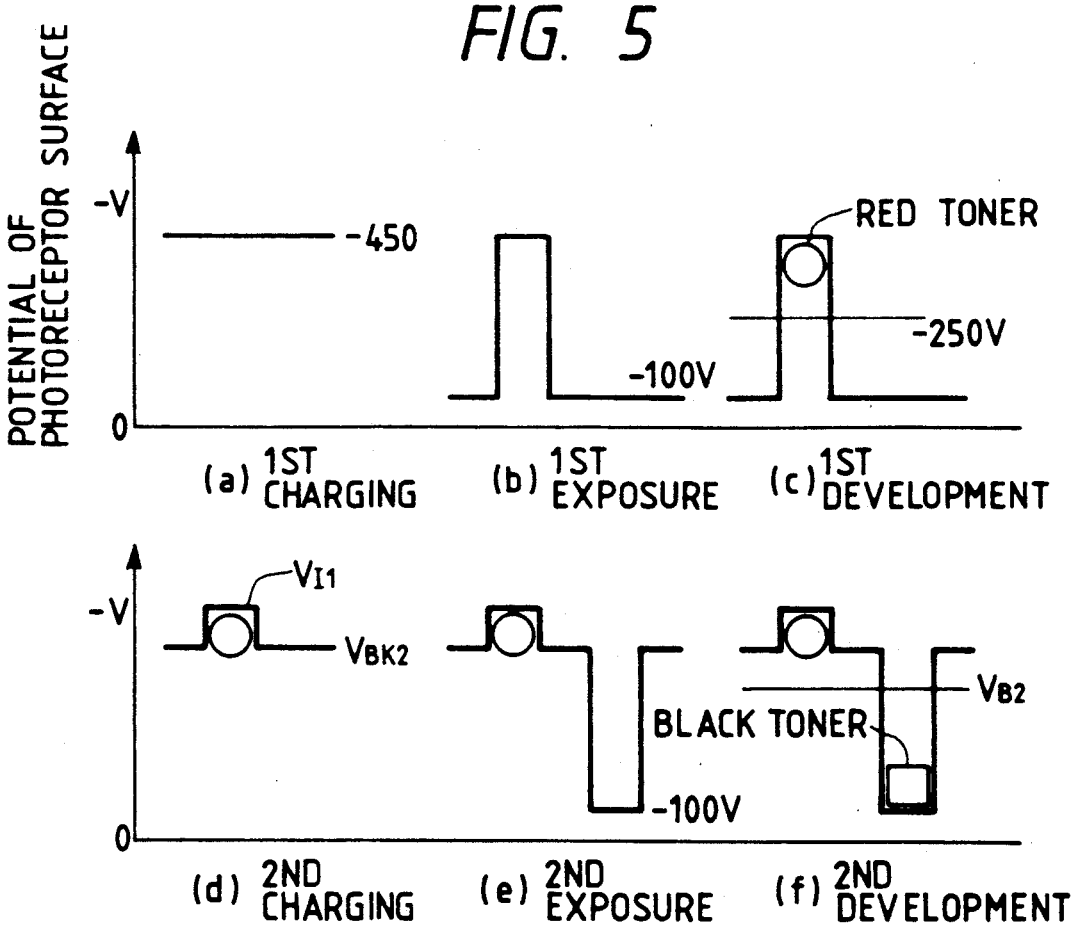
FIG. 5 is a chart showing a potential of a photoreceptor surface in Experiment 3.
Figure 6:
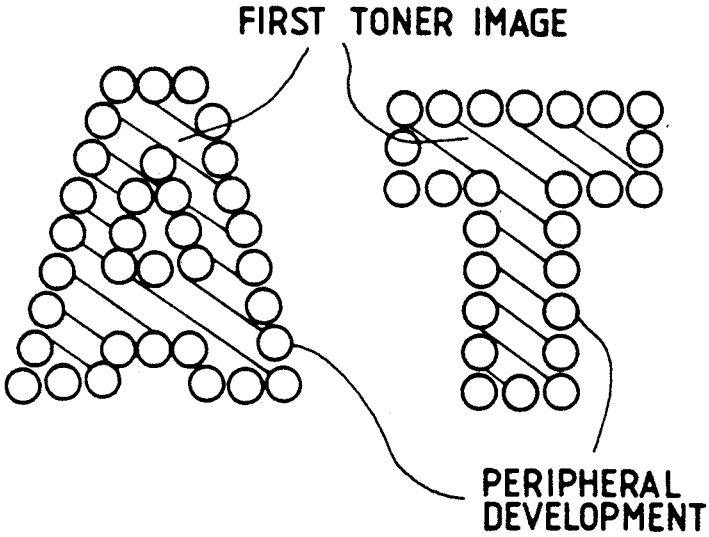
FIG. 6 is a chart showing development of a second color toner on peripheral portions of a first color toner.

First, the surface of the OPC was charged uniformly to −450 by the first charger 1*a* (FIG. 5(*a*)). Next, the non-image portion exposure was performed by the first exposure means 2*a* using laser light to form a positive latent image having an exposed portion potential of −100 V (FIG. 5(*b*)). This positive latent image was normally developed by the first development means 3*a* with a developing bias of −250 V (FIG. 5(*c*)). Then, charging was performed by the second charger 1*b* (FIG. 5(*d*)), and a negative latent image of an exposed portion potential of −100 V was formed by the second exposure means 2*b* using laser light (FIG. 5(*e*)). Finally, the reversal development was performed by the second development means 3*b* (FIG. 5(*f*)).

The relationship between the grid potential of the second charger 1*b* and the two phenomena, the peripheral development and the reduction in the first image density, was examined by changing the second charger grid potential. The distance between the grid and the photoreceptor 10*a* was selected to be 1.0 mm, and the corona wire voltage was set at −5.5 kV. The first image portion potential $V_I$ before the second charging was −400 V. The second developing bias was set at the non-image portion potential after the second charging plus 150 V to prevent the occurrence of color contamination and dirt on non-image portions.

Evaluation was performed in the same manner as in Experiment 1, and Table 3 was obtained. In the Table 3, $V_I$ represents the first image portion potential before the second charging.

TABLE 3

| | | | | | |
|---|---|---|---|---|---|
| $V_G$ (V) | −350 | −400 | −450 | −500 | −550 |
| $V_I$-$V_G$ (V) | −50 | 0 | 50 | 100 | 150 |
| $V_{BK2}$ (V) | −330 | −380 | −420 | −470 | −520 |
| $V_{I1}$ (V) | −400 | −400 | −450 | −500 | −550 |
| First image density reduction | 0.0 | 0.2 | 0.5 | 0.2 | 0.0 |
| Peripheral development | x | Δ | ○ | ○ | ○ |

The reason why the density reduction occurs in the −400 to −500 V range of $V_G$ is that since negative charges, having a polarity opposite to the charging polarity of the first toner, are applied, the charge quantity of the first toner is decreased to reduce its adhesion to the photoreceptor surface. It is understood from Table 3 that the density reduction can be prevented if the following relationship between the second charger grid potential $V_G$ and the first image portion potential $V_I$ is established:

$$|V_G| > |V_I|.$$

That is, when the first image portion potential $V_I$ is regarded as 0 V (reference potential), the second charger grid potential $V_G$ should be set to be opposite in polarity to the first non-image portion potential and the potential difference between $V_G$ and $V_I$ should be not less than 150 V. This is because charges are sufficiently applied to the first toner to thereby increase the quantity of negative charges, i.e., adhesion of the first toner to the photoreceptor surface, and to avoid scraping of the first toner in the second development. In addition, with this setting, since the first image is sufficiently charged to its peripheral portions, the peripheral development can also be prevented.

It is noted here that, in the embodiment described above, scraping of the first toner is avoided and color images of good resolution can be reproduced even with the magnetic brush developing method employed in the second development process, in which method the mechanical scraping of the first toner is more likely to occur compared with a non-contact developing method or a contact developing method using a one-component magnetic toner or a non-magnetic toner.

Although the photoreceptor is used as a latent image carrier in the above embodiment, a dielectric carrier may instead be used and a latent electrostatic image may be formed with, for example, a discharge recording head used in electrostatic printers or an ion flow control head disclosed in Japanese Unexamined Patent Publication No. Sho. 59-190854.

Although the two-color recording apparatus was described in the above embodiment, the present invention can also be applied to a three or more color recording apparatus in the same manner.

As described above, according to the present invention, if charges given by the scorotron in the second charging process have the same polarity as the charging polarity of the first color toner, the potential of the second charger grid is set to be equal to the non-image portion potential of the first latent electrostatic image, or set to have a polarity opposite to that of the image portion potential assuming that the non-image portion potential of the first latent electrostatic image is regarded as 0 V (reference potential). On the other hand, if charges given by the scorotron have a polarity different from the charging polarity of the first color toner, the potential of the second charger grid is set to have a polarity opposite to that of the non-image portion potential assuming that the image portion potential of the first latent electrostatic image is regarded as 0 V (reference potential). As a result, since the charging of the first image is performed satisfactorily to its peripheral portions, peripheral development can be prevented. Further, since charges are sufficiently applied to the first toner in the second charging, the adhesion of the first toner to the photoreceptor surface is increased, preventing the first toner from being electrically scraped off in the second development process.

Although the invention has been described in its preferred form with a certain degree of particularity, it is understood that the present disclosure of the preferred from has been made only by way of example and that numerous changes in the detail of construction and the combination and arrangements of parts may be resorted to without departing from the spirit and scope of the invention as claimed.

What is claimed is:

1. A color recording apparatus comprising:

first development means for developing a first latent electrostatic image with a first color toner, said first latent electrostatic image being formed on a latent electrostatic image carrier;

scorotron means, including a grid, for applying a charge to said latent electrostatic image carrier after the development of said first latent electrostatic image by said first development means, said scorotron means including:

means, responsive in the event that said charge applied by said scorotron means has the same polarity as a charging polarity of said first color toner, for setting a potential of said grid to a level equivalent to a potential of a non-image portion of said first latent electrostatic image or to a polarity opposite to a polarity of an image portion of said first latent electrostatic image with said potential of said non-image portion being regarded as the neutral polarity reference potential, and means, responsive in the event that said charge applied by said scorotron means has a polarity opposite to said charging polarity of said first color toner, for setting said potential of said grid to a polarity opposite to a polarity of said non-image portion with said potential of said image portion being regarded as the neutral polarity reference potential; and second development means for developing a second latent electrostatic image with a second color toner, said second latent electrostatic image being formed on said latent electrostatic image carrier.

2. The color recording apparatus according to claim 1, wherein said scorotron means includes means, responsive in the event that said charge applied by said scorotron means has the same polarity as said charging polarity of said first color toner, for setting said potential of said grid to a level such that a difference of said grid potential and said non-image portion potential is not less than 50 volts.

3. The color recording apparatus according to claim 1, wherein said scorotron means includes means, responsive in the event that said charge applied by said scorotron means has a polarity opposite to said charging polarity of said first color toner, for setting said potential of said grid to a level such that a difference of said grid potential and said image portion potential is not less than 150 volts.

4. The color recording apparatus according to claim 1, wherein said second development means includes magnetic brush means.

5. A scorotron, including a grid, for use in a color recording apparatus, said scorotron comprising:

means for applying a charge to a latent electrostatic image carrier after the development of a first latent electrostatic image with a first color toner on said image carrier;

means, responsive in the event that said charge applied by said charge applying means has the same polarity as a charging polarity of said first color toner, for setting a potential of said grid to a level equivalent to a potential of a non-image portion of said first latent electrostatic image or to a polarity opposite to a polarity of an image portion of said first latent electrostatic image with said potential of said non-image portion being regarded as the neutral polarity reference potential; and means, responsive in the event that said charge applied by said charge applying means has a polarity opposite to said charging polarity of said first color toner, for setting said potential of said grid to a polarity opposite to a polarity of said non-image portion with the potential of said image portion being regarded as the neutral polarity reference potential.

6. The scorotron according to claim 5, further comprising means, responsive in the event that said charge applied by said charge applying means has the same polarity as said charging polarity of said first color toner, for setting said potential of said grid to a level such that a difference of said grid potential and said non-image portion potential is not less than 50 volts.

7. The scorotron according to claim 5, further comprising means, responsive in the event that said charge applied by said charge applying means has a polarity opposite to said charging polarity of said first color toner, for setting said potential of said grid to a level such that a difference of said grid potential and said image portion potential is not less than 150 volts.

8. The color recording apparatus according to claim 1, wherein the latent electrostatic image carrier is a photoreceptor.

9. The color recording apparatus according to claim 1, wherein the latent electrostatic image carrier is a dielectric carrier.

* * * * *